United States Patent [19]

Westendorp

[11] 4,012,706

[45] Mar. 15, 1977

[54] SHEET-WOUND TRANSFORMER COILS

[75] Inventor: Willem F. Westendorp, Schenectady, N.Y.

[73] Assignee: General Electric Company, Schenectady, N.Y.

[22] Filed: Dec. 8, 1975

[21] Appl. No.: 638,613

[52] U.S. Cl. ..... 336/84; 336/219; 336/234

[51] Int. Cl.[2] ..... H01F 15/04

[58] Field of Search ..... 336/83, 84, 223, 232, 336/212, 214, 215, 219, 233, 197, 60, 221, 234

[56] References Cited

UNITED STATES PATENTS

| | | | |
|---|---|---|---|
| 1,335,837 | 4/1920 | Jacobson | 336/84 |
| 2,850,707 | 9/1958 | Wroblewski et al. | 336/83 |
| 2,907,965 | 10/1959 | Mercier | 336/84 |
| 2,962,679 | 11/1960 | Stratton | 336/221 |
| 3,014,189 | 12/1961 | MacKinnon et al. | 336/83 X |
| 3,366,907 | 1/1968 | Tipton | 336/197 |
| 3,609,613 | 9/1971 | Horn et al. | 336/83 |
| 3,663,910 | 5/1972 | Grubb | 336/60 |
| 3,750,070 | 7/1973 | Rissinger | 336/84 |

FOREIGN PATENTS OR APPLICATIONS

| | | | |
|---|---|---|---|
| 1,557,420 | 2/1969 | France | 336/212 |
| 913,281 | 9/1946 | France | 336/83 |
| 1,030,842 | 5/1966 | United Kingdom | 336/197 |
| 827,506 | 2/1960 | United Kingdom | 336/223 |

*Primary Examiner*—Thomas J. Kozma
*Attorney, Agent, or Firm*—Marvin Snyder; Joseph T. Cohen; Jerome C. Squillaro

[57] ABSTRACT

In sheet-wound transformer coils, excessive ohmic losses due to high current density at the sheet edges caused by a radial magnetic leakage field are avoided by adding apparatus adjacent the edges which may comprise individual strips that are transposed as the coil is wound. In one alternative embodiment, the apparatus adjacent the edges comprises separate parallel strips of high magnetic permeability material assembled in conjunction with the coils. In another alternative embodiment, wire-wound coils are employed at each edge of the sheet-wound coils.

2 Claims, 15 Drawing Figures

O
O
$i_x$
II
LOAD CURRENT DENSITY
O
O
WINDING
RADIAL LEAKAGE FLUX
CURRENT 0
0
23
21
LOAD
CURRENT
DENSITY
23
0
0
WINDING
RADIAL
LEAKAGE FLUX
CURRENT

SHEET-WOUND TRANSFORMER COILS

Introduction

This invention relates to transformers, and more particularly to sheet-wound transformer coils exhibiting reduced ohmic losses.

In a transformer comprised of sheet-wound coils of the type described and claimed in S. F. Philp application Ser. No. 618,459 filed Oct. 1, 1975 and assigned to the instant assignee, the magnetic leakage field is strongest between the low and high voltage windings. The axial component of the magnetic leakage field diminishes, from this high value, nearly linearly with radial distance within either winding, to approximately zero on the inside of the inner winding or outside of the outer winding. The strongest component of the leakage field is the axial component of the leakage field is the axial component, and thickness of the sheet metal employed in the coils may be chosen sufficiently small to result in low eddy current loss caused by the axial component of the leakage field in the sheet conductor despite its high conductivity, requiring use of a double sheet on either side of thin insulation, where $B_0$ is the leakage field maximum radial flux density component and $\delta$ is the skin depth.

Skin depth $\delta$ is slightly larger in sheet windings than in solid copper $\delta_{cu}$ because of the insulation employed within the high voltage winding, according to $$\delta = \delta_{cu} / \sqrt{S}$$

where $S$ is the space factor or fraction of copper thickness in the coil divided by total thickness of the coil. In large, sheet-wound transformers, the increased current density at the edges, due to radial leakage flux, can cause excessive heating. This current density $i_x$ adds to the normal load current density in the sheet windings and varies with distance Z from the nearest axial end of the coil according to the same exponential function as the magnetic flux density, or $$i_x = i_o \exp(-Z/\delta),$$

where $i_o$ is the additional current density at the extreme edge. It would be desirable to reduce this excessive heating and thus obviate the complexity and cost of accommodating such heating in the transformer.

Accordingly, one object of the invention is to prevent excessive heating at the edges of sheet-wound in some instances, in order to carry the maximum rated load current.

Above and below the median plane (or plane of symmetry normal to the axis of the coils) the leakage field exhibits radial components which cause a maldistribution of current in the sheet-metal windings; that is, current density is highest at the sheet winding edges, resulting in greater ohmic losses in the windings than if current density were uniform throughout the sheet. Since both the radial thickness and axial dimension of the sheet-wound high voltage coil are very large compared to the skin depth at 60 Hertz (or depth below the surface at which current density is one neper below the surface current density, and which, at room temperature, is 0.336 inch in copper and 0.43 inch in aluminum), the leakage field radial component $B_y$ is essentially zero within the winding and is confined to the region near the top and bottom axial ends of the winding where its magnitude varies as an exponential function of axial distance Z from the nearest axial end according to $$B_y = B_o \exp(-Z/\delta)$$

transformer coils.

Another object is to spread each of the current and magnetic field distributions of a sheet-wound transformer over a relatively wide margin.

Another object is to limit additional edge current density in a sheet-wound transformer coil to a value comparable to the load current density.

Briefly, in accordance with a preferred embodiment of the invention, an electrical transformer comprises a conducting sheet, overlaid by insulation, and a magnetic core. The conductive sheet is wound continuously in a plurality of turns about the core. Apparatus is situated closely adjacent at least one axial edge of the wound turns for carrying a large radial component of the magnetic flux leakage field established by current flow through the conductive sheet.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawings in which:

DESCRIPTION OF TYPICAL EMBODIMENTS

Figure 1:
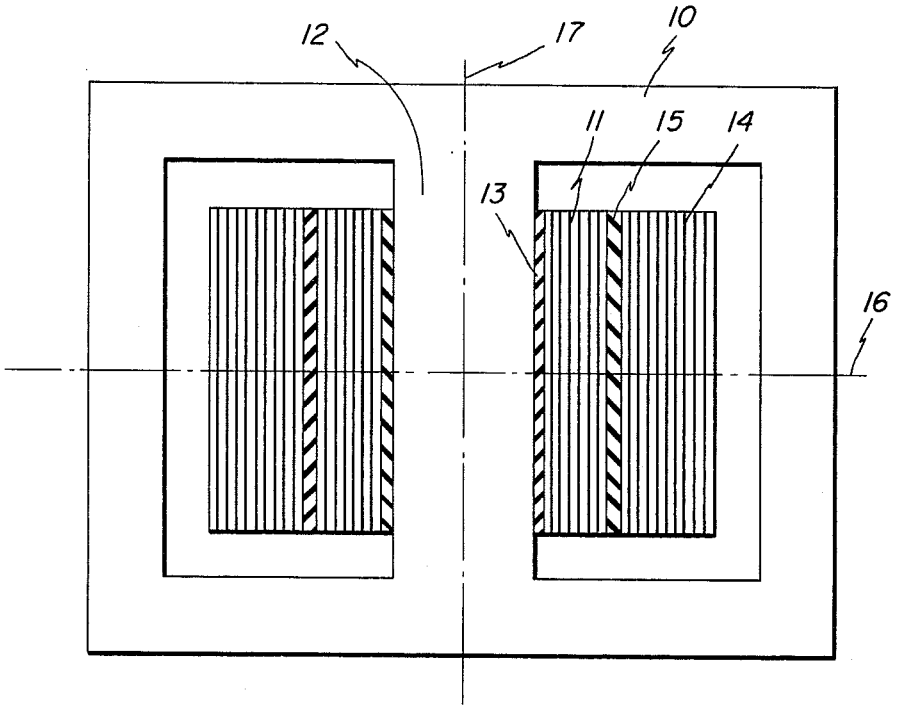
FIG. 1 PRIOR ART
FIG. 1 is a cross sectional side view of a prior type of single phase sheet-wound transformer.

FIG. 1 illustrates a sheet-wound transformer of the type described and claimed in the aforementioned S. F. Philp application Ser. No. 618,459. The transformer comprises a laminated core 10 having a low voltage winding 11 wound about an insulating, inner cylinder 13 encircling the center leg 12 of the core. A high voltage winding 14 is wound about insulation means 15 which separates the high and low voltage windings and acts as a reactance gap in the transformer. In both windings, each turn is insulated from the adjacent turn by polymer film insulation (not shown). Cooling ducts (not shown) may extend through the windings in the manner described in the aforementioned Philp application.

In operation, current passing through the sheet windings sets up a field of magnetic leakage flux which, in the region of the windings, is of greatest intensity in the axial direction in the reactance gap between the high and low voltage windings. At the median plane 16, which is the plane of symmetry perpendicular to the axis 17 of the transformer, the leakage field essentially has no radial components. As distance from median plane 16 along axis 17 increases so as to approach the axial end of coil 11, the leakage field manifests increasingly stronger radial components which reach their maxima at the ends of the coil; that is, the radial component of the leakage field is essentially zero where enclosed by sheet windings in the vicinity of the median plane and is confined to the top and bottom end regions of the winding where its magnitude varies according to the expression for $B_y$ stated, supra. This is because the radial thickness and axial dimension of sheet-wound outer coil 14 are very large compared to the skin depth at 60 Hertz.

In large, sheet-wound transformers, current density at the edges, induced by the radial component of the leakage field, adds to the normal load current density, resulting in increased ohmic losses which generate excessive heat. The embodiment of FIG. 2, however, sharply reduces these increased ohmic losses and thereby avoids the attendant excessive heating.

Figure 2:
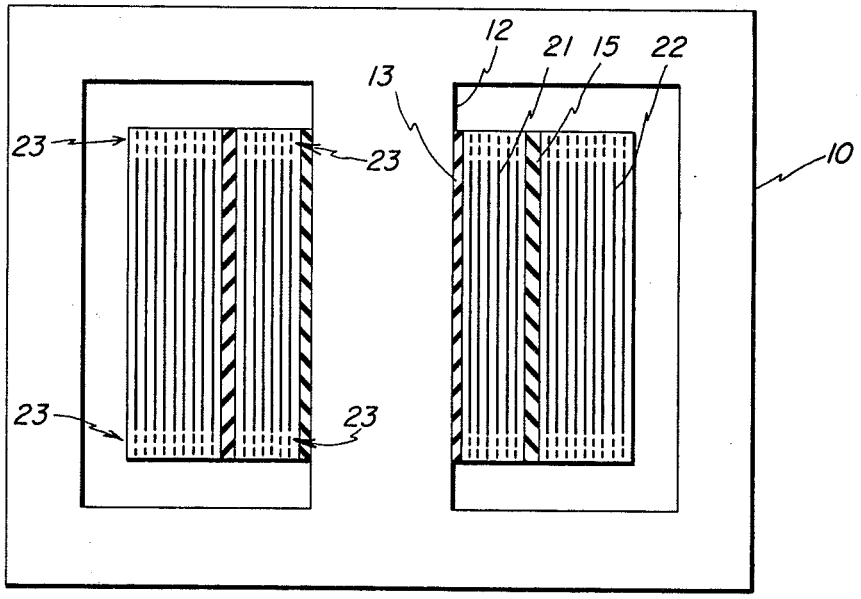
FIG. 2 is a cross sectional side view of an improved type of single phase sheet-wound transformer constructed in accordance with the teachings of the instant invention.

The general configuration of the transformer shown in FIG. 2 is substantially identical to that of the transformer shown in FIG. 1, except that adjacent the axial ends of inner, or low voltage, coil 21 and outer, or high voltage, coil 22 are a plurality of generally annular strips 23. Since these annular strips are situated in the region of significant radial components of leakage flux, the edge currents that would otherwise be induced in the sheet windings are induced in the strips. By transposing the strips, the edge currents are made to distribute themselves.

In a typical power transformer with a low voltage winding of three inches radial thickness, width of the margin in which the edge currents are made to flow should be about 14 times the skin depth in order to make the additional edge current density comparable to the load current density. Specifically, where copper sheet windings are employed, it is advantageous to force the edge currents to distribute themselves over 14 + 0.336 inches instead of being principally concentrated in the 0.336 inch skin in the edge region of the sheet metal. To accomplish this result, a margin of about 4.7 inches of the layer should, instead of comprising continuous sheet metal, be divided into annular strips each about 0.33 inches wide insulated from each other and transposed. Since each of the strips thus carries the same current throughout the 4.7 inch margin, the radial magnetic field decreases linearly from a maximum value at the axial end face of the coil to a negligible value where the margin encounters the continuous sheet metal. In general, since the maximum value of the magnetic leakage field is proportional to the radial thickness of the low voltage winding (assumed here to be the primary winding) and the current density, the subdivided and transposed margins adjacent to the sheet metal conductor should be of axial width approximately 1.5 times the radial thickness of the primary winding. For medium power transformers with a primary winding radial thickness of one inch or less, however, the margin becomes small and subdivision and transposition may be omitted, the excess heat from the edges of the sheet winding being distributed by thermal conduction through the sheet winding.

Figures 3A, 3B, 3C:
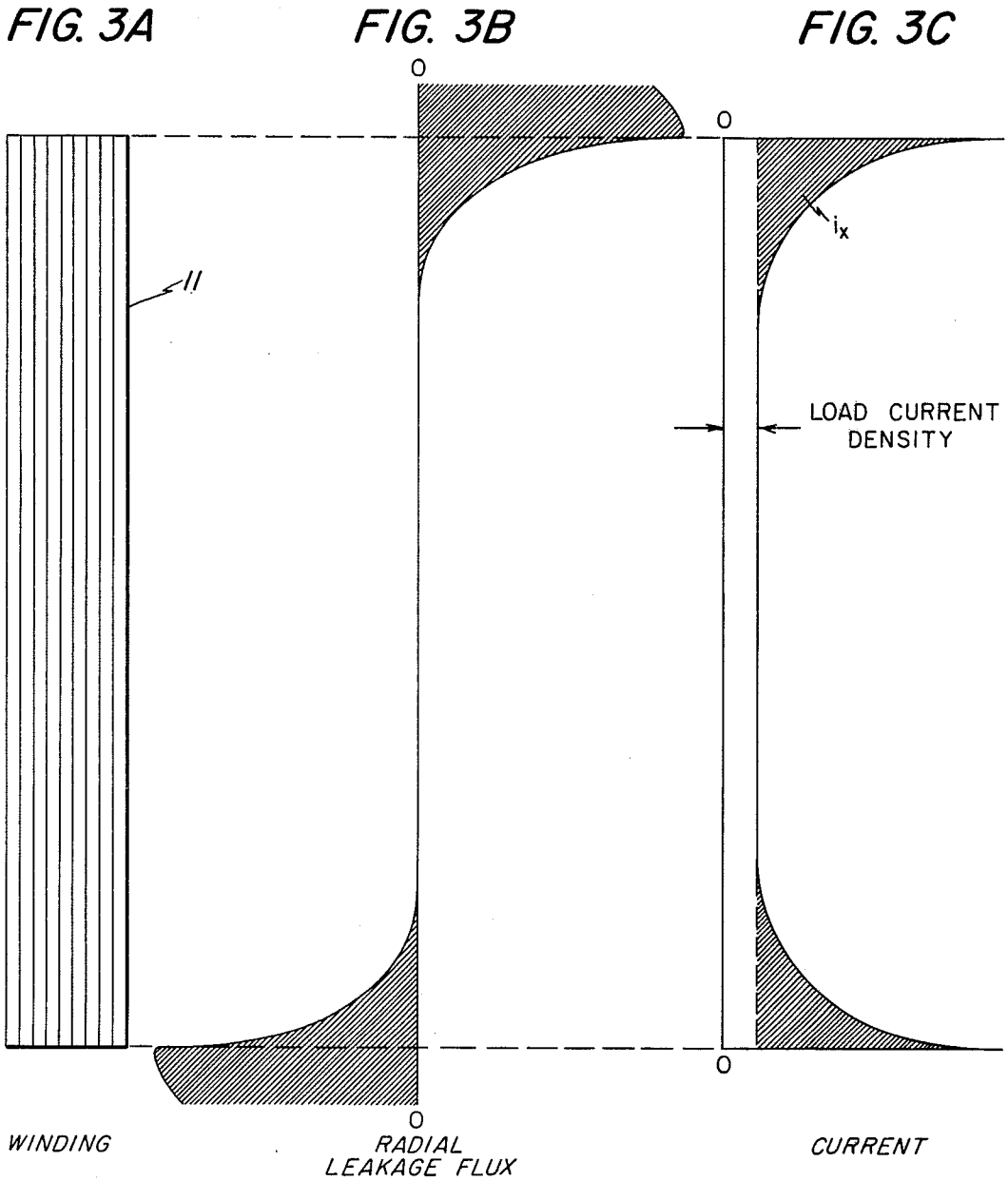
FIGS. 3A, 3B and 3C are illustrations to assist in explaining operation of a conventional sheet-wound transformer coil.

The effect of subdividing and transposing the margins in the sheet windings may be seen graphically by referring first to FIGS. 3A, 3B and 3C. The curves of FIGS. 3B and 3C are each depicted along a linear axis corresponding to axial length of the windings of FIG. 1, such as winding 11 shown in FIG. 3A, and located between windings 11 and 14. Moving axially outward in either direction from the interior of the coil, the radial leakage flux, as shown in FIG. 3B, rises exponentially toward a maximum extant at each end of the windings. Because of this magnetic field configuration, total current density in each of windings 11 and 14, comprised of the sum of the load current density component, which is substantially uniform over the entire axial length of each of the windings, plus the additional edge current density component $i_x$ (shown shaded), rises exponentially to a maximum at the axial ends of the coil which may be as much as five times the load current density.

Figures 4A, 4B, 4C:
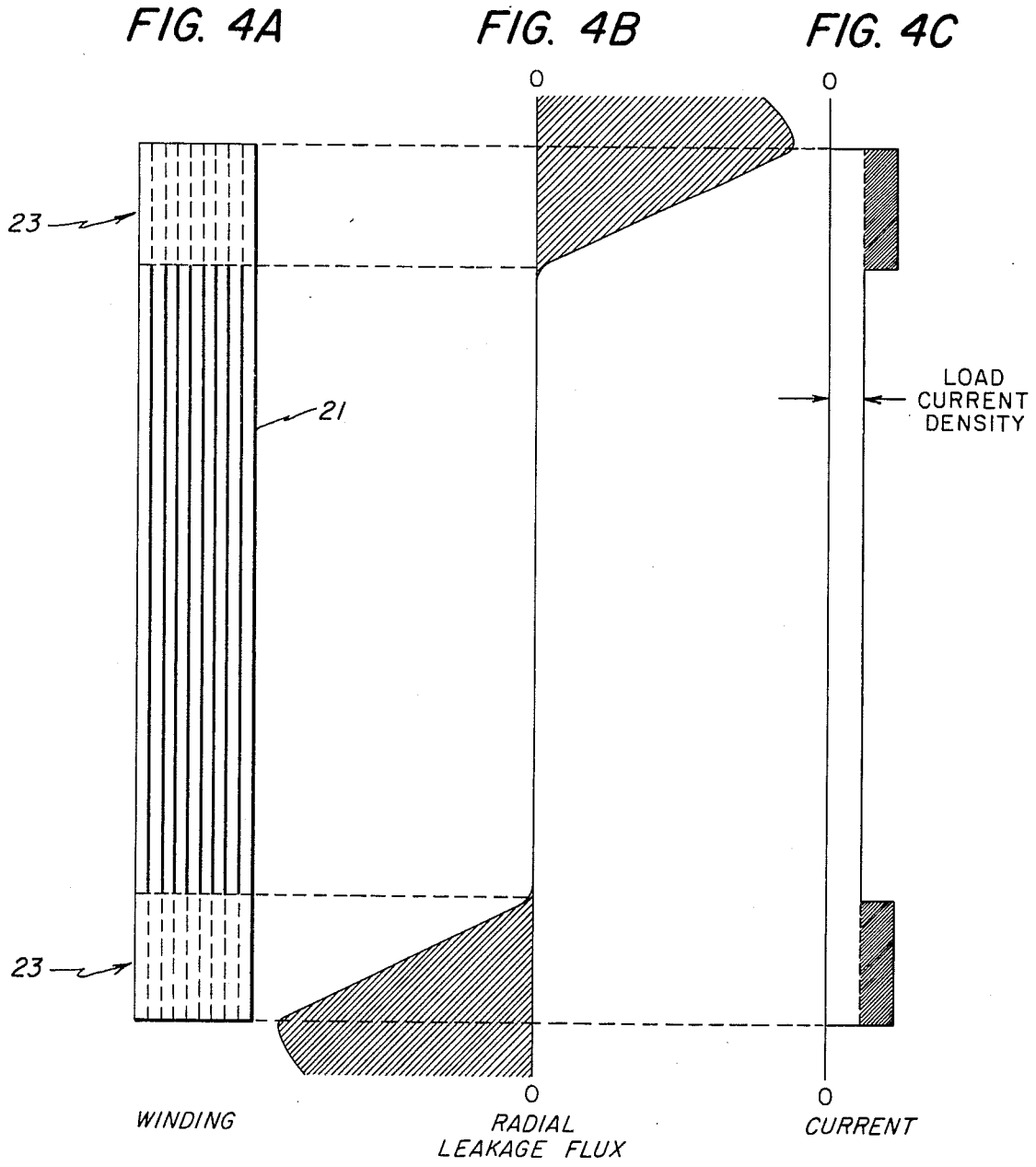
FIGS. 4A, 4B and 4C are illustrations to assist in explaining operation of a sheet-wound transformer coil constructed in accordance with the teachings of the instant invention.

Reference to FIGS. 4A, 4B and 4C shows, by way of contrast, the improvement achieved with the apparatus of FIG. 2. The curves of FIGS. 4B and 4C are each depicted along a linear axis corresponding to axial length of the windings of FIG. 2, such as winding 21 and margins 23 shown in FIG. 4A, and located between windings 21 and 22. Moving axially outward in either direction from the interior of the coil, the radial leakage flux, as shown in FIG. 4B, increases substantially linearly from a very low value at the junction of subdivided and transposed margin 23 and continuous sheet 21, to a maximum value extant at each end of the windings. Because of this magnetic flux characteristic, total current density in each of windings 21 and 22 and associated margins 23, comprised of the sum of the load current density component which, as in the apparatus of FIG. 1, is substantially uniform over the entire axial length of each of the windings and associated margins 23, plus the additional edge current density component in the transposed margins (shown shaded), increases substantially as a step function at the junction of the continuous sheet and each subdivided and transposed margin, moving axially outward in either direction from the interior of the coil. Typically, total current density in the subdivided and transposed margin may be approximately twice the load current density.

Figure 5:
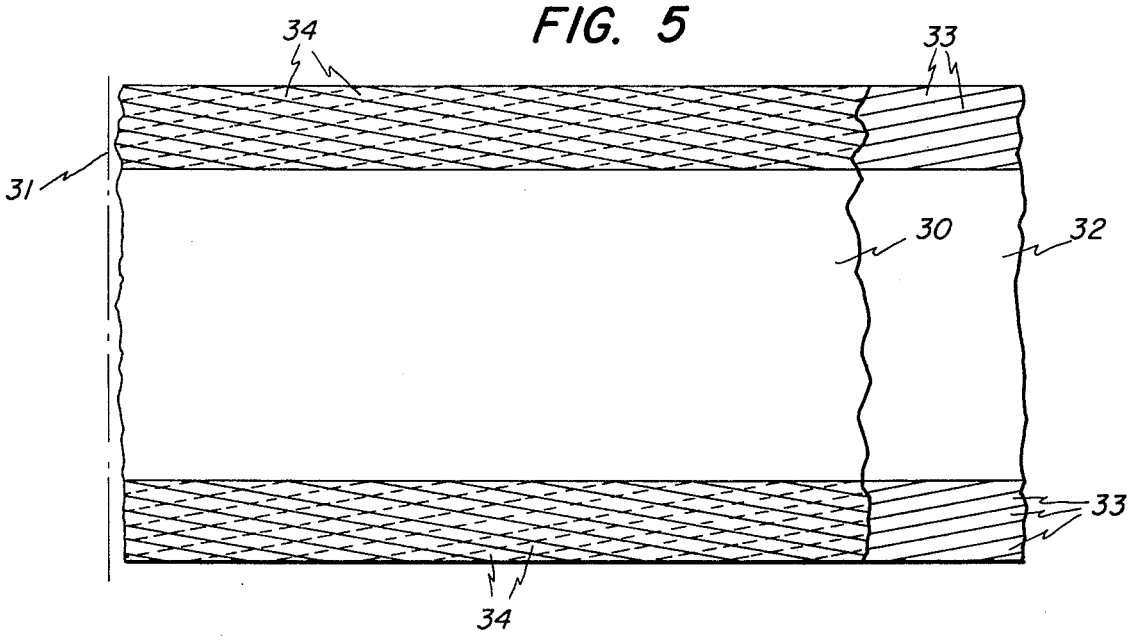
FIG. 5 is a plan view of one configuration of metallic sheet and its adjacent margins, from which a transformer coil of the type shown in FIG. 2 may be wound.
Figure 6:
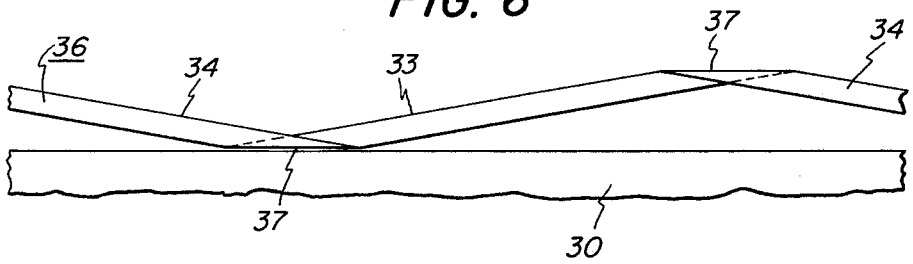
FIG. 6 is a plan view of a single metallic strip employed in the margin alongside the metallic sheet shown in FIG. 5.

FIG. 5 is an illustration of one form of subdivided, transposed strips that may be employed in the margin, or region outside the continuous metal sheet in the apparatus of FIG. 2. Sheet 30 is wound about an axis 31 such that strips formed at each of the margins of sheet 30 are directed generally annularly when the coil is wound. Sheet 30 is formed atop a second sheet 32, without any insulation therebetween so as to be in electrical contact with each other in order to form a thickness comparable to that of the double strips in the margins. Sheet 30 and its margins are shown broken away to expose sheet 32 thereunder and the covered portions 33 of the strips in the margins. The uppermost portions 34 of the strips are visible in the margins of continuous sheet 30.

Figure 7:
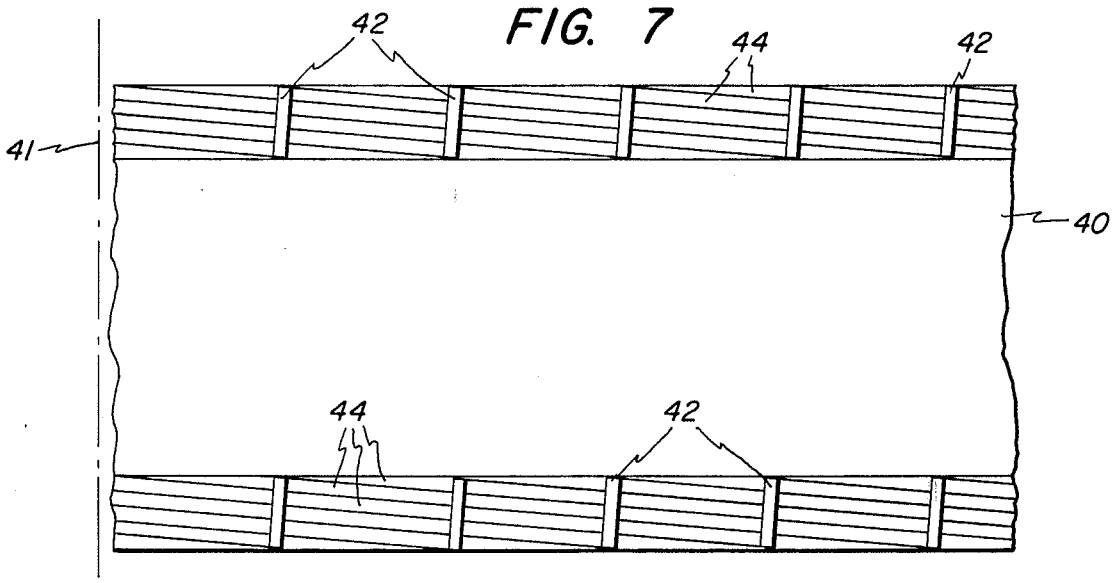
FIG. 7 is a plan view of another configuration of metallic sheet and its adjacent margins, from which a transformer coil of the type shown in FIG. 2 may be wound.

Each of strips 33 is integral with one of strips 34, respectively, at the outer edges of sheets 30 and 32. Additionally, each of strips 33 is integral with a different one of strips 34, respectively, at their axially-outermost edges. Strips 33 and 34 are formed merely by bending a single linear strip 36 along diagonal folds 37, as shown in FIG. 7, so that no separate joining operations are needed for strips 33 and 34. Thus the margins adjacent sheets 30 and 32, as shown in FIG. 5, are fully and continuously transposed. Connections between the solid sheet metal and the transposed strips in the margins on either side thereof are made at the start and finish of the welding, and also at two or three intermediate locations within the winding. This is because the highest current required in the margins exists on the inside of the inner winding and on the outside of the outer winding. The required current in the margins decreases as the reactance gap between the primary and secondary windings is approached in a radial direction. By making multiple cross connections between the margins and the solid sheet metal, a different value of current can be established between each pair of successive connections.

A coil constructed in the manner described in conjunction with the apparatus of FIG. 5 forces the load current in the axial margins of the coil to distribute itself through a larger volume of metal than in a coil constructed of solid sheet metal turns. The load current is thus not concentrated in the skin on the edge region of the sheet metal. As a result, the radial component of magnetic leakage flux builds up substantially linearly in an axial direction over the region containing the transposed strips, out to each axial edge of the coil. The linear field, in turn, induces current in each of the transposed strips which collectively constitute an edge current density in the transposed margin of the sheet that is of a substantially uniform, low value over the entire axial width of the transposed region, dropping abruptly to substantially zero where the transposed region encounters the continuous region. This is unlike the situation in a continuous sheet conductor without a transposed margin, wherein the current induced by magnetic leakage flux rises to an extremely large value at the axial edges of the coil. Since ohmic losses, and hence heat generation, at any location in the coil are proportional to the square of the current density at such location, the large current peak experienced at the edge of the sheet conductor in the continuous sheet coil is clearly undesirable in that heat generation at that location can easily be excessive to the point where the transformer is damaged.

In the alternative, sheets 30 and 32 of FIG. 5 may be unified in a single sheet. However, the margin still requires two layers of transposed strips in order to accomplish the result of substantially linearizing the radial leakage flux field.

FIG. 7 is an illustration of another form of subdivided, transposed strips 44 that may be employed in the margin outside the continuous constituent of sheet metal windings in the apparatus of FIG. 2. Sheet metal 40 is wound about an axis 41 together with strips 44 adjacent each of the margins. Strips 44 are directed generally annularly when the coil is wound, while cross strips 42 join, at essentially regularly-spaced locations along sheet 40, the innermost and outermost strips 44 in the margins of sheet 40 and are directed generally axially when the coil is formed. Although each of cross strips 42 can cause a slight bulge in the winding when it is wound, by placing the cross strips one-half turn or one whole turn apart, the added thickness of the coil can be made to fall well outside the window of the core, where more room is available.

As in the embodiment of FIG. 5, a coil wound from the apparatus of FIG. 7 forces the load current at the coil edges to distribute itself through a larger volume of metal than in a coil of solid sheet metal turns, and thus avoids concentrating the load current in the skin on the edge region of the sheet metal. As a result, the radial component of magnetic leakage flux builds up substantially linearly in an axial direction over the region containing the transposed strips, out to each axial edge of the coil. The linear field, in turn, induces current in each of the transposed strips which collectively constitute an edge current density in the transposed margin of the sheet that is substantially uniform at a relatively low value over the entire axial width of the transposed region, dropping abruptly to substantially zero where the transposed region encounters the continuous region. This current density also adds to the substantially uniform load current density in the sheet, and as in the embodiment shown in FIG. 5, results in reduced overall heating in the margin.

The margin of sheet 40 divided into transposed strips is joined to sheet 40 at the start and finish of each winding, as well as at several intermediate locations. This allows different values of current to exist between each pair of these successive connections. Axial strips 42 occur more frequently than the connections between the margin of sheet 40 and sheet 40 itself.

The marginal subdivision and transposition illustrated in FIGS. 5 and 7 makes it possible to construct a sheet metal winding transformer without excessive heating at the edges of the sheets. If axial width of each margin is approximately 1.5 times the radial thickness of the inner coil, a current density of about twice that of the load current is provided in the margins, and local heat production per unit sheet metal volume is then only about four times that in the solid sheet metal.

Figure 8:
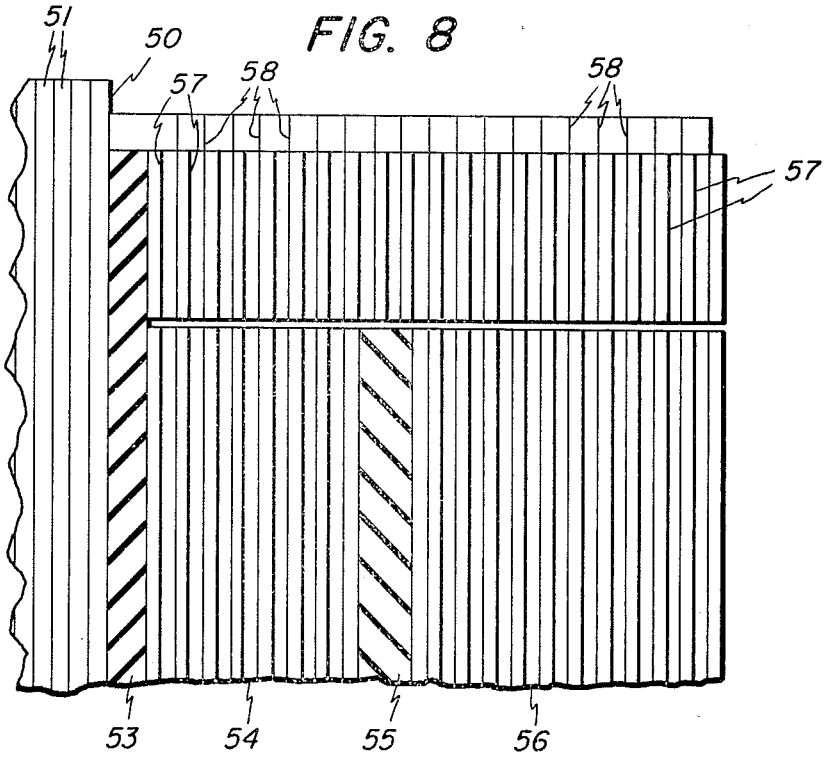
FIG. 8 is a cross sectional side view of another configuration of single phase sheet-wound transformer constructed in accordance with the teachings of the instant invention.

FIG. 8 illustrates embodiment of the invention, especially useful in transformers of less than about 2,000 KVA rating, viewing the windings at the location where they extend outside of the core window (not shown). Width of the sheet metal employed in forming the windings of this embodiment is equal to axial length of the windings. Core 50 is made up of a plurality of adjacent laminations 51, of which several are visible. Wrapped about the outermost one of laminations 51 is an insulating, high strength material 53, such as epoxy-fiberglass. Sheet-wound inner coil 54 is wound about insulating material 53 and itself is wrapped with an insulating, high strength material 55, such as epoxy-fiberglass, serving as a reactance gap between outer coil 56 wound thereon and inner coil 54.

A plurality of high magnetic permeability strips 57, preferably comprised of enamel-insulated silicon steel, are situated at each axial end of sheet windings 54 and 56, only where the windings are projecting beyond the plane of core and yokes, only one axial end of the windings being shown. Each silicon steel strip is insulated from each adjacent silicon steel strip, as by paper strips 58 which extend axially through windings 54 and 56 except in the region axially aligned with insulating material 55. Silicon steel strip 57 rests against, and preferably is glued to, windings 54 and 56 at their axial ends projecting beyond the plane of core and yokes. To match conductor thickness in low voltage winding 54, several thicknesses of silicon steel strip may be bundled and glued together. To break up azimuthal paths small gaps in the silicon steel strip may be left once or twice per lamination.

Width of silicon steel strip 57, in the axial direction, may be computed from an estimate of the radial flux density of the diverted magnetic leakage flux. This radial flux density $B_r$ is compared to the flux density in the core $B_c$ and width of the silicon steel strip should be $$(B_c/B_r) \times t$$

where $t$ is the core lamination thickness. Making the silicon steel strip of this width keeps eddy current losses in the iron low.

A sharp turn of magnetic leakage field direction, from axial to radial, is prevented at the ends of windings 54 and 56 by the presence of strip 57 since, by placing the strip close to the axial ends of coils 54 and 56 so as to enable the strip effectively to pick up the leakage flux without short-circuiting high voltage winding 56, the leakage flux emerges from windings 54 and 56 in a generally axial direction. This prevents excessive losses caused by any radial component of leakage flux.

Figure 9:
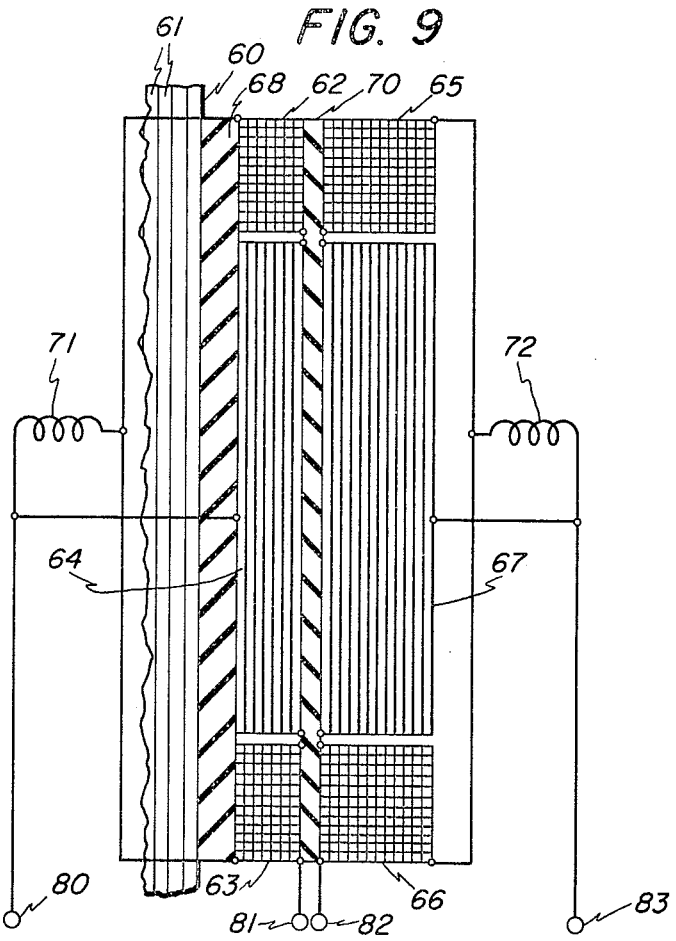
FIG. 9 is a cross sectional side view of still another configuration of single phase sheet-wound transformer constructed in accordance with the teachings of the instant invention, showing a schematic diagram of a circuit used in conjunction therewith.

FIG. 9 illustrates yet another embodiment of the invention useful transformers of less than about 2,000 KVA rating where width of the sheet metal employed in forming the windings is equal to axial length of the windings. In this embodiment, a wire-wound section 62 and 63 is situated at each axial end, respectively, of inner sheet winding 64 and a wire-wound section 65 and 66 is situated at each axial end, respectively, of outer sheet winding 67. As in the embodiment of FIG. 8, core 60 is made up of a plurality of laminations 61. Wrapped about the outermost one of laminations 61 is an insulating, high strength material 68, such as epoxy-fiberglass, extending from the axially-outermost end of wire windings 63 to the axially-outermost end of wire windings 62. Sheet -wound inner coil 64 and wire windings 62 and 63 are thus wound about insulating material 68 and themselves are wrapped with an insulating, high strength material 70, such as epoxy fiberglass, serving as a reactance gap between outer coil 67 wound thereon and inner coil 64. Coils 65 and 66 are preferably of square cross section, having all four sides equal in size to the radial thickness of high voltage winding 67, while axial length of each of coils 62 and 63 also corresponds to the radial thickness of winding 67.

Wire-wound coils 62 and 63 are connected in parallel through sheet-wound coil 64, while wire-wound coils 65 and 66 are connected in parallel through sheet-wound coil 67. If the wire-wound coils are thus made to carry current densities comparable to the current densities carried by the sheet windings connected in parallel therewith, the edge current density in the sheet windings is reduced considerably and brought well within an acceptable range. However, current density in the wire windings may be as much as 1.6 times as high as in the sheet winding connected in parallel therewith. It is therefore necessary to limit current in the wire windings. This may be accomplished by connecting a relatively small inductive reactance 72 in series with parallel-connected wire windings 62 and 63 and by connecting another relatively-small inductive reactance 72 in series with parallel-connected wire windings 65 and 66. Thus the parallel windings 62 and 63 are connected in series with reactance 71, and the combination is connected in parallel with sheet metal winding 64. Similarly, the parallel windings 65 and 66 are connected in series with reactance 72, and the combination is connected in parallel with sheet metal winding 67. Therefore, each of wire windings 62 and 63 is coupled to terminals 80 and 81 of sheet metal coil 64, while each of wire windings 65 and 66 is coupled to terminals 82 and 83 of sheet metal coil 67. For a transformer of 100 MVA rating or more, the reactance ratings would be about 0.002 times the transformer rating.

The function of the wire-wound extensions in the apparatus of FIG. 9 is to allow magnetic leakage flux from between the layers of sheet metal and from between windings 64 and 67 to orient itself in a more axial direction at the edges of windings 64 and 67 instead of allowing it to turn sharply in that region. A potential cause of excessively high currents in the sheet metal windings is thus avoided.

Figure 11:
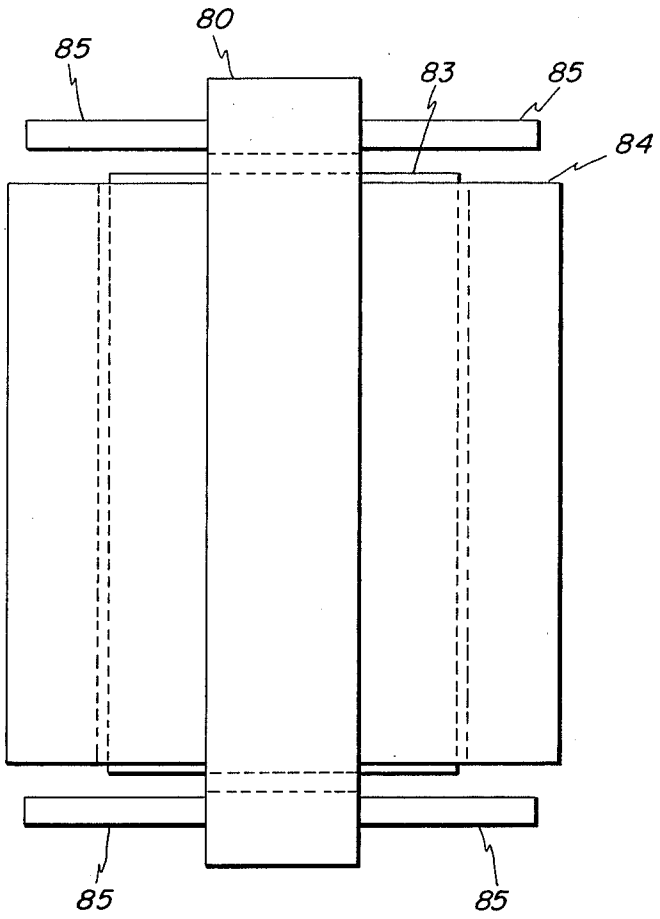
FIG. 11 is an end view of the embodiment shown in FIG. 10.
Figure 10:
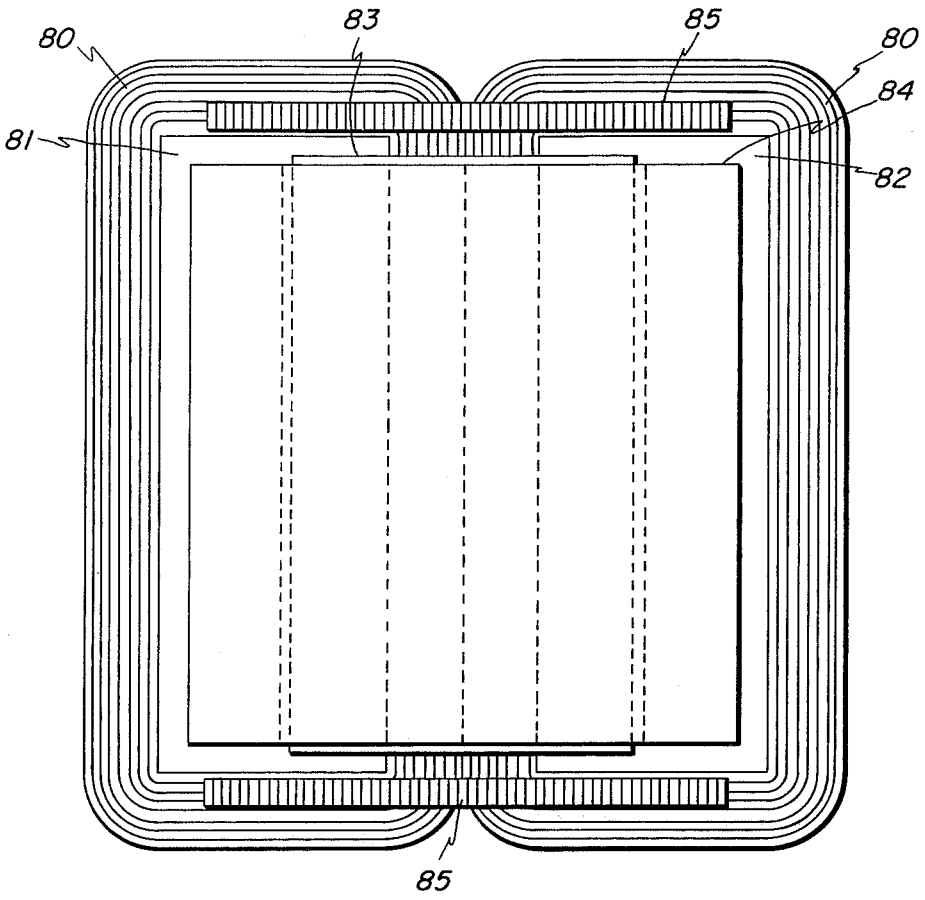
FIG. 10 is a cross sectional side veiw of still another embodiment of the invention.

FIGS. 10 and 11 illustrate yet another embodiment of the invention, as applied to a wound core transformer. Thus core 80, as shown in FIG. 10, comprises two rectangularly-wound strips of magnetic steel forming windows 81 and 82. The two halves of the core thus formed are held against each other as by a strap (not shown) which encircles the outer perimeter of the core halves. A low voltage sheet metal winding 83 encircles the center leg of the core, while a high voltage sheet metal winding 84 encircles winding 83.

An assembly 85 comprising separate magnetic steel laminations, each of which is insulated, as by an enamel coating or surface oxide, and the laminations joined together as by gluing with an epoxy resin, is affixed in place against core 80 on either side thereof, at each axial end of the sheet metal windings, such that the plane of each separate lamination is perpendicular to the plane of the core. In general, therefore, the plane of substantially each lamination of assembly 85 intersects the plane of the wound strips at some angle other than zero, the angle of intersection for most of the laminations being approxmately 90°. This minimizes eddy current loss at the locations where leakage flux enters the core. As indicated in FIGS. 10 and 11, low magnetic reluctance lamination assembly 85 extends outward from core 80 beyond essentially the entire sheet metal windings, in order to intercept most of the leakage flux therefrom. Thus this configuration also prevents any sharp turn of magnetic leakage field direction, from axial to radial, at the axial ends of windings 83 and 84, thereby minimizing eddy current losses in the windings near their axial ends.

The foregoing describes improved sheet-wound transformer coils in which excessive heating at the coil edges is prevented. The current and magnetic field distributions of the sheet-wound transformer are each spread over a relatively wide margin, and additional edge current density in the sheet-wound transformer coil is limited to a value comparable to the load current density.

While only certain preferred features of the invention have been shown by way of illustration, many modifications and changes will occur to those skilled in the art. It is, therefore, to be understood that the appended claims are intended to cover all such modifications and changes as fall within the true spirit of the invention.

I claim:

1. An electrical transformer comprising:

at least one conductive sheet overlaid by insulation;

a closed loop magnetic core, said conductive sheet being wound continuously in a plurality of turns about said core; and a plurality of axially-oriented planar strips of low magnetic reluctance electrically insulated from each other and directed from said closed loop magnetic core substantially perpendicular to the plane of said closed loop magnetic core, said strips being situated closely adjacent at least one substantially entire axial edge of said turns and carrying a large radial component of the magnetic flux leakage field established by current flow through said conductive sheet.

2. An electrical transformer comprising:

a closed loop core of magnetic material;

a first coil wound about said core, said first coil being formed from a first conductive sheet overlaid by insulation;

a second coil wound about said first coil, said second coil including a second conductive sheet overlaid by insulation; and a plurality of axially-oriented planar strips of low magnetic reluctance electrically insulated from each other and directed from said closed loop core substantially perpendicular to the plane of said closed loop core, said strips being situated closely adjacent at least one substantially entire axial edge of each of said first and second coils for carrying a large radial component of the magnetic flux leakage field established by current flow through said conductive sheet.

* * * * *